United States Patent [19]

Lorang

[11] 4,023,810

[45] May 17, 1977

[54] GOLF TRAINING APPARATUS

[76] Inventor: Walter R. Lorang, 2239 W. Maple Road, Walled Lake, Mich. 48088

[22] Filed: Mar. 22, 1976

[21] Appl. No.: 669,257

Related U.S. Application Data

[63] Continuation-in-part of Ser. No. 655,684, Feb. 6, 1976.

[52] U.S. Cl. ..... 273/186 C; 273/187 B; 273/195 B

[51] Int. Cl.² ..... A63B 69/36

[58] Field of Search ..... 273/187 R, 187 A, 187 B; 35/29 A, 186, 195 B, 183 A

[56] References Cited

UNITED STATES PATENTS

| | | | |
|---|---|---|---|
| 2,189,613 | 2/1940 | Paulsen | 273/187 R |
| 2,777,697 | 1/1957 | Crossot | 273/187 R |
| 3,229,981 | 1/1966 | Taber | 273/187 R |
| 3,420,529 | 1/1969 | Goranson et al. | 35/29 A X |
| 3,550,946 | 12/1970 | Menendez | 273/187 R |
| 3,955,821 | 5/1976 | Spedding | 273/187 B |

*Primary Examiner*—George J. Marlo

*Attorney, Agent, or Firm*—William T. Sevald

[57] ABSTRACT

The golf club swing training apparatus has a board on which the positions of the ball and the player's feet are designated for each club. It gives the player a scale of measurement for distances beween himself and the ball and between his feet for each club. It also gives the player the angles for his feet and the relative positions between the target foot and the off-target foot as closer to or farther from the ball. Flags or flexible strips are provided adjacent the ball positions to delineate the path of a club head in a proper inside-out swing. Means are provided to adjust the positions of the ball and the feet to accommodate players of different height and leg length as well as club shaft length. Rocker foot plates with associated signal means are provided to give the player a measurement of his body position on the backswing and the downswing to aid in holding his body without shift on the backswing and to shift the body toward the target on the downswing. The apparatus enables a player to measure his own positions and actions and enables an instructor to graphically demonstrate proper and improper positions and actions to a player.

6 Claims, 15 Drawing Figures

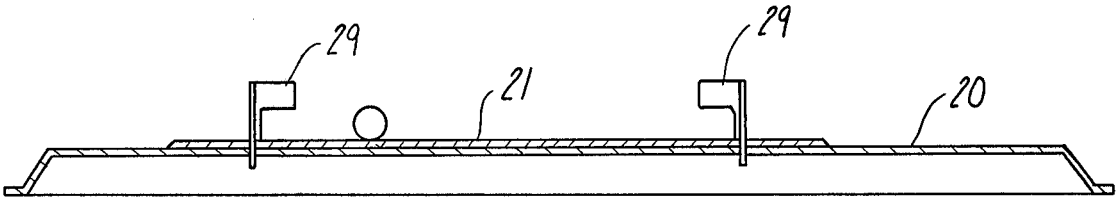
Fig-2
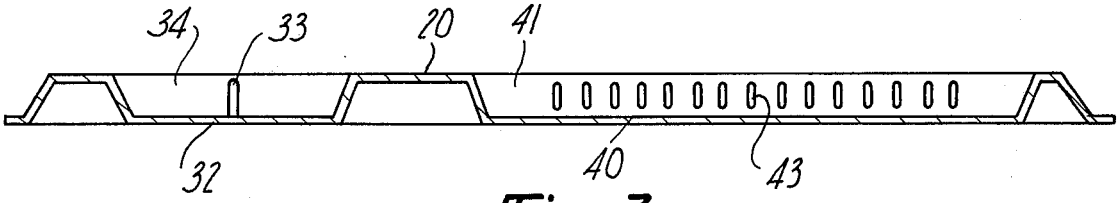
Fig-3
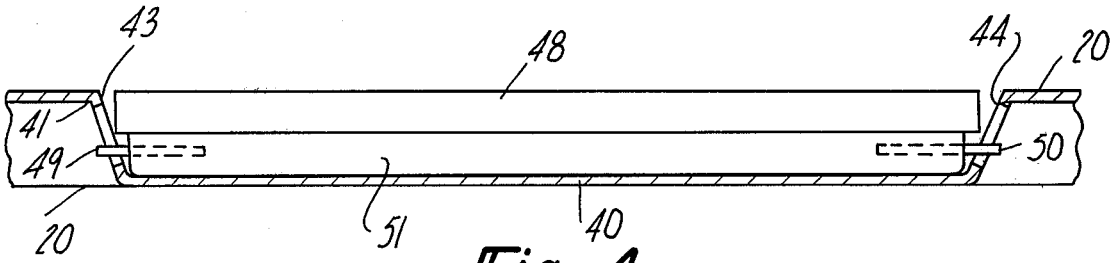
Fig-4
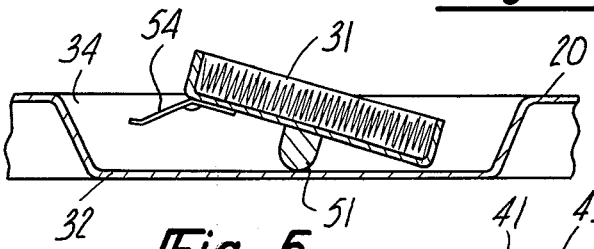
Fig-5
Fig-6
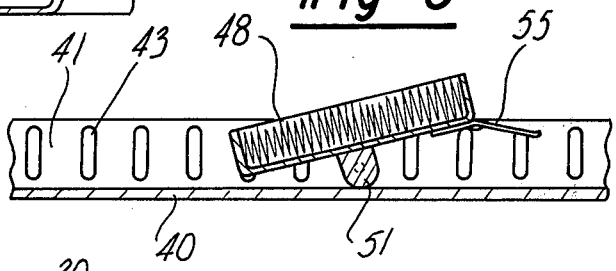
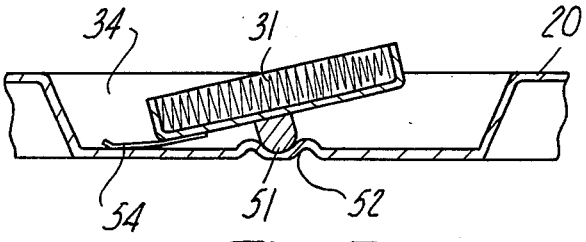
Fig-7
Fig-8
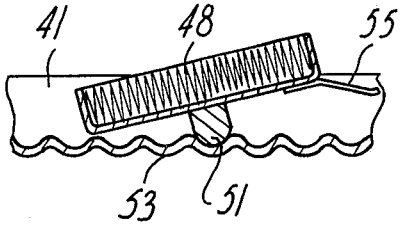

GOLF TRAINING APPARATUS

This application is a continuation in part of the application Ser. No. 655,684, filed Feb. 6, 1976, by said Walter R. Lorang for Golf Swing Training Apparatus.

BACKGROUND OF THE INVENTION

In golf, the swing of the club at the ball is of paramount importance. A player with a good swing has an advantage and a player with a poor swing is at a serious disadvantage. The basic elements of a good swing are described in various ways, but they all result in very similar, if not identical, positions and actions.

It is generally accepted that the player should stand with his feet apart; that his target heel should lie off a line to the ball which is normal to the target; that his target foot should angle toward the target; that his off-target foot should angle away from the target; that his knees should be bent and angled toward one another; that he should have his feet pressed toward one another at the start of the swing; that he should stand with his buttocks back of his heels in a slightly tail-heavy balance; that his head should stay at one point in space and not move; that his left arm should be held firmly straight; that he should cock his wrists on the backswing and uncock them on the foreswing; that he should execute a smooth swing; that he should keep his eye on the ball; that he should follow through completely — and at no time let his off-target foot tilt in the off-target direction; that he should shift his weight to his target foot during the downswing; that his target foot should tilt toward the target on the downswing, etc.

With all this and more to know about, understand, remember, and execute, the average player has little chance of getting his swing "grooved" so that he can play the ball without consciousness and overt attention to the elements of his swing.

Moreover, the average player does not fully understand the proper positions and what he should be doing in his swing. He believes he is doing things which he is actually not doing. He also believes that he is not doing things which he is actually doing. This comes about from the fact that a player can't see himself as others see him and from the fact that he has no scale or reference by which he can measure his own positions, actions and performance. And this latter is applicable to the good player as well as the poor player as both need help — some more than others — but they need it. The really good players know when they need it and take a lesson or two from a pro to get straightened out. The really poor players have a need which is greater than some "straightening out;" they need basic grounding on fundamentals and some way to convey to them just what these are and just how they are to gauge their performance so that they will know when they are doing things right and so they will know when they are doing things wrong.

Professional teachers and instructors may add to or subtract from some of the above and have their own particular stance, foot angles and distance, etc.. Variations from the foregoing and therefore acknowledged. It will be understood that the foregoing is by way of demonstrating at least some of the problems that make golf a great game. It will also be understood that they do not constitute any limitation on the scope or purpose of the apparatus of the invention which is to provide aid for some of the basic needs of a player.

SUMMARY OF THE PRESENT INVENTION

The apparatus of the present invention has a board for positioning the ball and the player's feet relative to one another and both the ball and the feet relative to the target.

A ball line is established on the board. The ball line lies normal to a line extended from the ball to the target. Ball positions are marked along the ball line. The farthest out ball position is for the No. 1 wood. The ball position closest in is for the pitching wedge or sand wedge. This corresponds to the lengths of the shafts of the various clubs. The ball-line may be marked on the board. Whether marked or not, the ball-line provides a base reference to locate the feet properly.

A position for the target foot is established on the board at an angle to the ball line and at a proper distance from the ball positions. The target foot position is indicated by a foot plate, foot-print, pivot means, or other marking. The center line of the target foot position lies angling toward the target at about 12° to 28° off the ball line. The heel portion of the target foot position lies spaced slightly off the ball line toward the target. The target foot of the player is thus indicated at a generally accepted angle and at a generally accepted distance from the ball position. The distance from the back of the heel of the target foot position to the ball position for the No. 1 wood is about 42 inches and to the ball position for the pitching wedge about 29 inches, for example. These distances may be varied as desired to make adjustments for taller and shorter players and longer and shorter club shafts. The position of the target foot is the same for all clubs. The angle of the target foot position may be at the mean angle of 20°. Nicklaus's target foot amgle is 24° and he says the angle may be greater; Sam Snead's is 18°; Julius Boros' is 20°; and Ben Hogan's is 22°, for example. Means are provided for adjusting the angle of the target foot position as desired and/or as suggested to a player by a professional instructor.

Positions for the off-target foot are provided on the board in multiple. The off-target foot positions are spaced various distances from the target foot position. The distances correspond to the various desired spacing between the feet of a player for the various clubs. The center-line of each off-target foot position lies at an angle of about 0° to 8° to the ball line in the off-target direction. The longest distance between the off-target foot position to the target foot position corresponds to the longest club shaft, the No. 1 wood, a distance of about 20 inches at the heels of the positions. The nearest positions or shortest distance between the foot positions corresponds to the shortest club shaft, the pitching or sand wedge, a distance of about 7 inches.

The multiple off-target foot positions also are spaced various distances from the ball position; the No. 1 wood position is farthest from the ball; the wedge is closest to the ball; and the clubs in between are staggered closer to the ball from the No. 1 wood to the wedge. This puts the multiple off-target positions collectively on a slant of about 12° to a line normal to the ball line. Thus, the off-target foot position for the No. 1 wood is farther from the ball position than the target foot position. Thus, the off-target foot position for the wedge is closer to the ball position than the target foot position. A scale is provided on the board designating the staggered positions of the off-target foot for each particular club;

the distance from club-to-club is about ¾ inch to 1 inch on the scale.

The positions of the feet are shown by a foot plate, pad or print. A rockable foot plate is preferred. The rockable foot plate has a pivot means or a rocker bar on the bottom along its center line so that it can tilt from side to side. Slots on the board and pivotal locater pins on the foot plate establish the various positions. Also, locater grooves on the board are provided to locate the foot plates. Signal means are provided on the foot plates to signal the player when he is properly and/or improperly rocking the foot plates in conjunction with his backswing and the shift of his body on the downswing as more fully explained hereinafter and in my co-pending patent application Ser. No 655,684, filed Feb. 6, 1976.

An anti-scuff mat is superposed on the board at the ball positions. The ball positions are marked on the scuff mat. The scuff mat is movable toward the foot positions for shorter players using shorter shaft clubs and away from the foot positions for taller players with longer shaft clubs. Also, the scale of the off-target foot position is movable toward and away from the target foot position to accommodate the difference in distance between the feet of the players having short and long legs. Thus, the apparatus is adjustable to suit the difference in size of players and the difference in shaft lengths.

Markers, such as flags or up-standing flexible strips, are provided on the board to delineate the path of the club head through the ball when the club head is moving on the inside-out angle of a proper swing. Means are provided on the board or the scuff mat to position the markers. The means comprises designated spots through which the club head should travel in the inside-out swing. Two groups of spots are provided; one group on the target side of the ball designations and one group on the off-target side of the ball designations. The group on the target side lie farther away from the positions of the feet than the ball designations. The group on the off-target side lie closer to the positions of the feet than the ball designations. The groups are both designated for the various clubs similar to the ball position designations. When the ball is located at a particular position for a particular club, such as a five iron, the flags or strips are located on the five iron designations of the two groups. This gives the player the visual indications of the path of the club head through the ball in an inside-out swing. With the flags, the player may take a swing through the ball and if he does not contact and pivot a flag on both sides of the ball in his swing, he knows he has not executed a proper inside-out swing.

The apparatus thus provides a player with a frame of reference, a scale of distances wnd measurement of angles to graphically illustrate and distinguish proper positions and proper execution.

Various other novel advantages of the invention will become apparent from the detailed description of the illustrated exemplary embodiments taken in conjunction with the accompanying drawings.

DESCRIPTION OF THE DRAWINGS

FIG. 2 is a cross-sectional view of the apparatus seen in FIG. 1, taken on the line 2—2 thereof showing the scuff mat superposed on the board, a ball, and the flags.

FIG. 3 is a cross-sectional view of the apparatus seen in FIG. 1, taken on the line 3—3 thereof showing the slot means in the board for positioning the target and off-target foot plates.

FIG. 4 is an enlarged cross-sectional view of the apparatus seen in FIG. 1, taken on the line 4—4 thereof showing a rockable foot-plate with locater pivot pins at the toe and heel coacting in the slots of the board to locate the foot plate.

FIG. 5 is an enlarged cross-sectional view of the apparatus seen in FIG. 1, taken on the line 5—5 thereof showing the rockable foot-plate for the target foot equipped with a signal clicker and inclined toward center in the proper backswing position.

FIG. 6 is an enlarged cross-sectional view of the apparatus seen in FIG. 1, taken on the line 6—6 thereof showing the off-target foot plate inclined toward center in the proper backswing position and equipped with a signal device.

FIG. 7 is a view similar to FIG. 5, showing the target foot plate tilted toward the target in the proper downswing and foreswing position and showing a formed groove for locating the foot plate.

FIG. 8 is a view similar to FIG. 6 showing the off-target foot plate tilted toward center in the proper downswing and foreswing positions and showing formed grooves for locating the foot plate.

DETAILED DESCRIPTION OF THE ILLUSTRATED EMBODIMENTS

Figure 1:
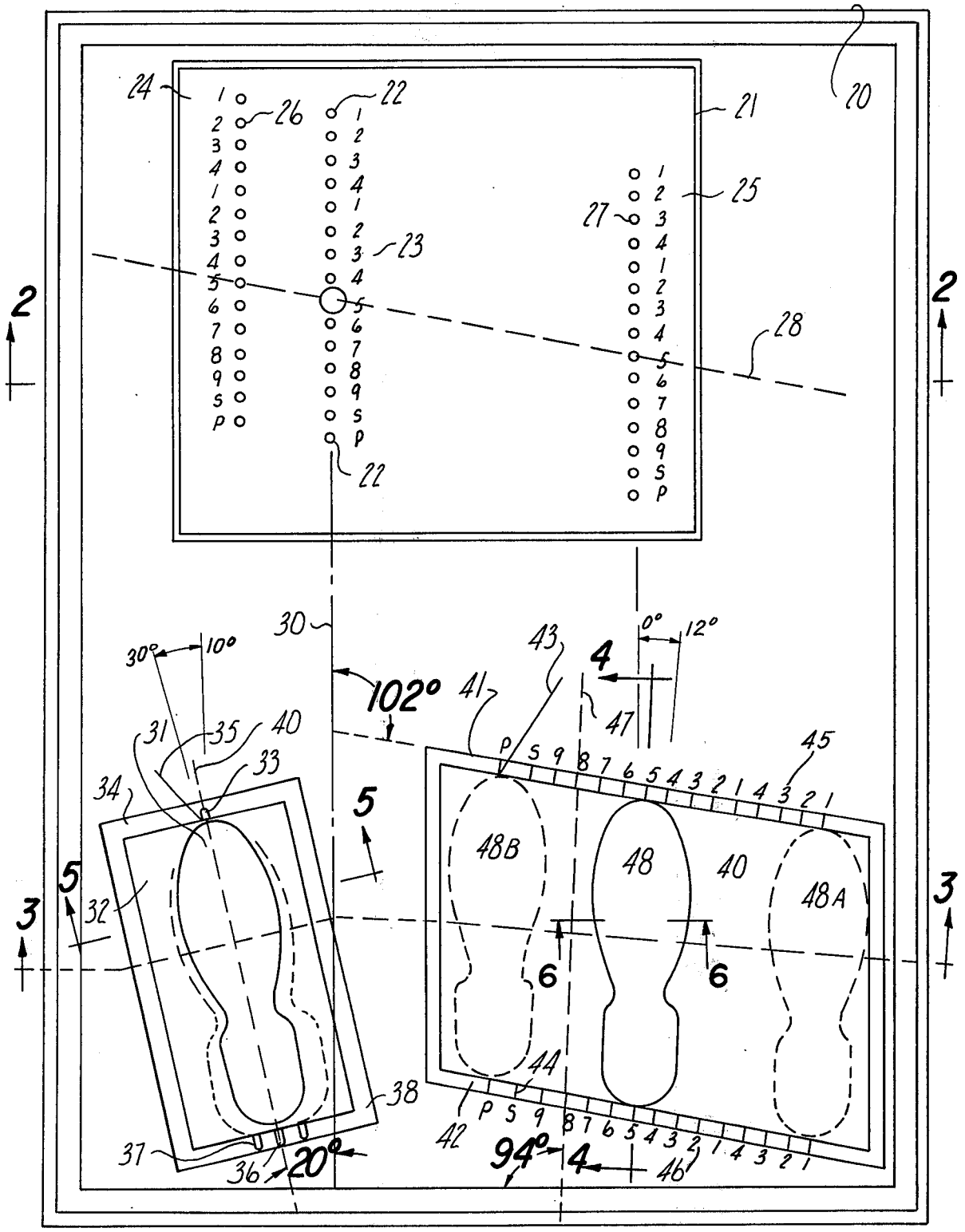
FIG. 1 is a top plan view of the board for a right handed player showing a scuff mat at the upper end carrying the ball positions and the spots for the flags; showing the target foot position as a foot plate at the bottom left; and the off-target foot position as a foot plate at the bottom right together with a scale for locating the off-target foot plate for the various clubs.

Referring now to the drawings wherein like reference numerals refer to like and corresponding parts throughout the several views, a board 20 provides the base structure for the apparatus. The board 20 may be metal as seen in FIGS. 1–8 or other material as seen in FIGS. 9–15, including rigid or flexible mediums such as plywood, masonite, linoleum, plastic, etc..

Referring to FIGS. 1–8, a scuff-mat 21 overlies the board 20. Ball positions 22 are marked on the scuff mat 21. The ball positions 22 may be painted, marked by apertures for receiving tees, etc.. A scale 23 lies beside the ball positions 22. The scale 23 designates the club to be used at the particular ball position 22. The clubs are designated on the scale as the 1, 2, 3 and 4 woods, the 1, 2, 3, 4, 5, 6, 7, 8 and 9 irons, the sand wedge, and the pitching wedge.

Two auxiliary scales 24 and 25 lie on either side of the ball positions 22 and the ball scale 23. A series of flag spots 26 lie relative to the scale 24 and a series of flag spots 27 lie relative to the scale 25. The flag spots and scales 24 to 27 correspond to the ball positions 22 and scale 23. Flag scale 24 and spots 26 lie on the target side of the ball positions 22 and scale 23 and flag scale 25 and spots 27 lie on the off-target side. Target flag spots 26 and flag scale 24 lie outwardly and off-target flag scale 25 and flag spots 27 lie inwardly relative to the ball positions 22 and ball scale 23. A line 28 running through like club numbered flag spots 26–27 and ball positions 22 thus describes an inside-out angle for the path of a club head properly swung by a player in a proper inside-out swing. Flags 29 or flexible strips are placed at the flag spots 26 and 27 relative to a ball placed on the ball positions 22, FIGS. 1 and 2. This visually indicates to the player the angle of the path of a club head in the proper inside-out swing such as shown for the five iron.

A ball line 30 on the board 20 leads from the ball positions 22 to the near end of the board 20. A target foot position 31 is indicated on the board 20 relative to the ball line 30. The heel of the target foot position 31 lies spaced off the ball line 30 on the target side. The target foot position 31 may be marked on the board 20 or superposed thereon as with a felt, cloth, plastic, or metal foot plate or print. In FIGS. 1–8, a metal foot plate is used as illustrative. A depression or well 32 is formed in the board 20 and a slot 33 cut in the slanting wall 34. A pin 35 lies in the slot 33. The pin 35 is attached to the foot plate 31 and pivotally or rockably positions the foot plate 31 at the toe end. A pin 36 attached at the heel of the foot plate 31 lies in a slot 37 in a wall 38 of the board 20. This pivotally mounts the heel end of the foot plate 31. The center line 40 of the foot plate 31 with the heel pin 36 in the center slot 37 thus lies on an angle of about 20 degrees to the ball line 30. By putting the heel pin 36 in slots 37 on either side of the center slot 37, the angle of the center line may be changed to 16° and 24° respectively. This enables the player to adjust the angle of the target foot position 31 to best suit his particular stance and physical constitution.

A large depression or well 40 is formed in the board 20 on the off-target side of the ball line 30 adjacent the near end of the board 20 and approximately opposite the depression or well 32 of the target foot position. The well 40 is bounded at the top and bottom by slanting walls 41 and 42. A series of slots 43 are fomed in the wall 41 and a series of slots 44 are formed in the wall 42. A scale 45 corresponding to the various clubs adjoins the slots 43 and a similar scale 46 adjoins the slots 44. A line 47 through similarly designated slots 43 and 44 describes an angle of about 0° to 8° to a line parallel to the ball line 30.

An off-target foot plate 48 has a pin 49 at the toe end and a pin 50 at the heel end, FIGS. 1 and 4, lying in the slots 43 and 44 respectively. The pins 49, 50 may pivotally support and locate the foot plate 48 or the foot plate 48 may have a longitudinal rocker bar 51 for support and the pins 49, 50 may be locating means. Also, the floor of the depressions 32 and 40 may have grooves 52 and 53 as seen in FIGS. 7 and 8 and the rocker bar 51 and grooves 52 and 53 used as both the locating and pivoting means with the pins and slots deleted.

The off-target foot plate 48 is thus movable to any position of the scales 45 and 46 for any club from the No. 1 wood down to the wedges as indicated on the scales. Thus the off-target foot plate 48 lies farther from the target foot plate 31 for the longer shaft clubs and closer for the shorter shaft clubs as indicated by dotted lines showing 48A and 48B of FIG. 1.

The foot plates 31 and 48 have clicker signal means 54 and 55 respectively, to advise the player of proper and improper body shifts during his swing at a ball.

Figure 9:
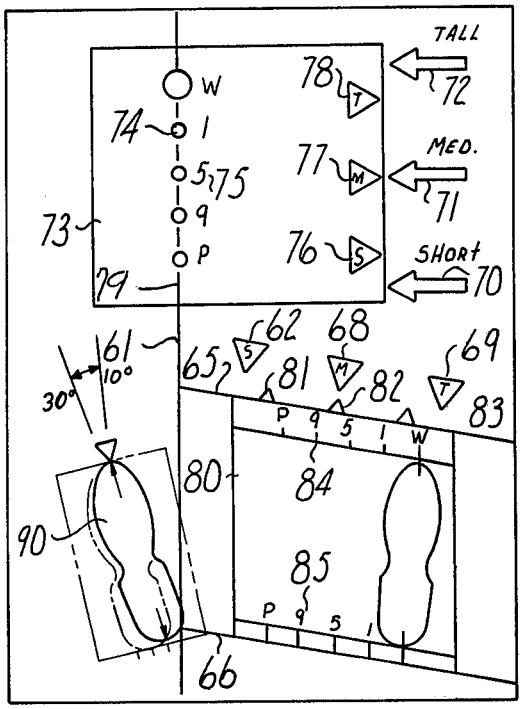
FIG. 9 is a reduced plan view showing of a modified board having an adjustable scuff mat for position the ball at various distances from the foot positions and an adjustable scale for positioning the off-target foot plate at various distances from the target foot plate.
Figure 10:
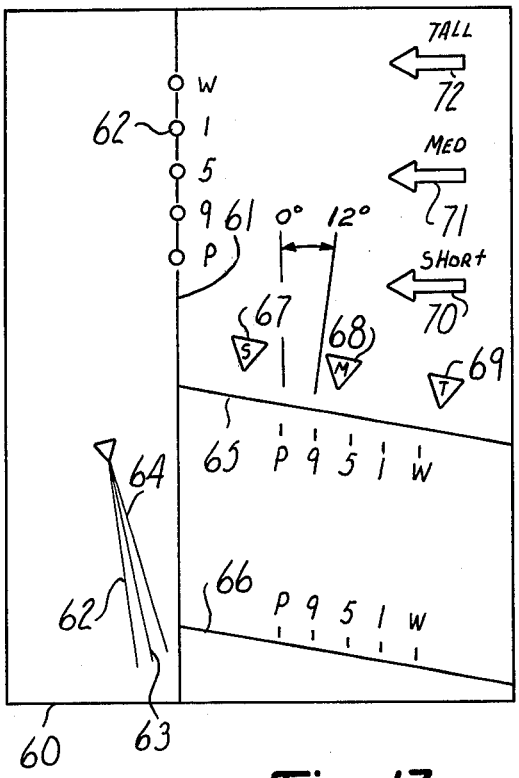
FIG. 10 is a view of the board of FIG. 9 with the scuff mat, foot plates and scale removed.
Figure 11:
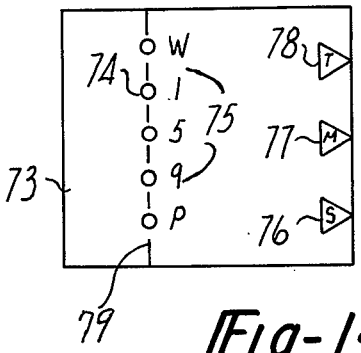
FIG. 11 is a plan view of the scuff mat of FIG. 9.

Referring now to FIGS. 9–15, a board 60, FIG. 10, has a ball line 61, ball positions 62, target foot position lines 62, 63 and 64 lying at various angles to the ball line 61 such as 14°, 20° and 26° respectively. Off-target foot scale lines 65 and 66 are marked on the board 60 and lie at an angle to the ball line at about 10° to 14° to a line normal to the ball line, not shown. Short, medium and tall arrow markers, 67, 68 and 69 respectively lie adjacent to the line 65. Also, short, medium and tall arrow markers 70, 71 and 72 respectively lie spaced from and relative to the ball line 61. A scuff mat 73, FIG. 11, has ball positions 74, a club scale 75, and short, medium and tall arrow markers 76, 77 and 78 respectively. A ball line 79 is also marked on the scuff mat 73. The scuff mat 73 of FIG. 11 is superposed on the board of FIG. 10 as seen in FIG. 9 with the ball line 74 of the mat 73 aligned along the ball line 61 of the board 60 and the arrows 76–78 on the mat 73 positioned relative to the arrows 70–72 on the board 60 to suit the individual player using the apparatus.

Figure 13:
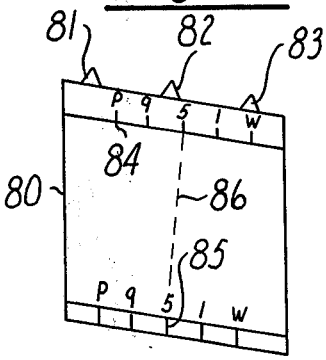
FIG. 13 is a plan view of the off-target scale of FIG. 9.

An off-target foot locater mat 80, FIG. 13, has short, medium and tall arrow markers 81, 82 and 83 respectively, a top club scale 84, and a bottom club scale 85. The scales 84 and 85 are off set relative to one another to describe an angle of about 12° to a line parallel to the ball line 61 on the board 60 as indicated by the dotted line 86. The locater mat 80 is overlaid on the board 60 between the lines 65 and 66 on the board 60 as seen in FIG. 9, with the arrows 81–83 on the mat 80 at the desired arrows 67–69 on the board 60 to suit the size and physique of the player as desired. This establishes the locations of the off-target foot relative to the ball line 61 and the target foot indicator lines 62–64.

Figure 12:
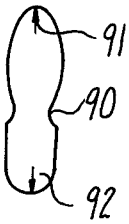
FIG. 12. is a plan view of a foot plate of FIG. 9.

A foot plate, pad or print 90, FIG. 12, has a toe arrow 91 and a heel arrow 92. A foot print 90 is overlaid on one of the target indicator lines 62–64 to select the desired angle for the target foot of the player using the apparatus, as seen in FIG. 9, with the toe and heel arrows 91 and 92 aligned along the desired target foot angle line 62–64 on the board 60. A like foot print 90 is overlaid on the off-target foot locater mat 80 with the foot print 90 toe and heel arrows 91 and 92 matched against the top club scale 84 and bottom club scale 85 on the mat 80 as seen in FIG. 9, such as for the No. 1 wood as shown.

With the apparatus of FIGS. 9–13, the foot prints 90 for both the target foot and the off-target are stationary or non-tilting.

Figure 14:
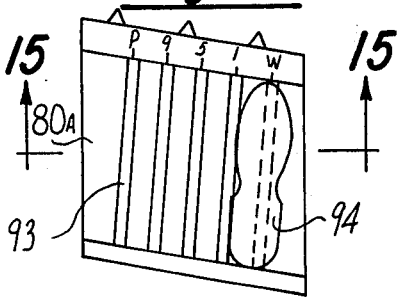
FIG. 14 is a view similar to FIG. 13 showing a modified grooved scale locating a rockable foot plate.
Figure 15:
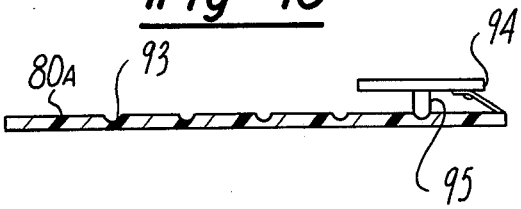
FIG. 15 is an enlarged cross-sectional view of the modified grooved scale and foot plate of FIG. 14 taken on the line 15—15 thereof.

An off-target foot mat 80A, FIGS. 14–15, has grooves 93 and a foot plate 94 has a rocker bar 95 lying in a groove 93 to rockably locate the foot plate 94 for the off-target foot. Similarly, the target foot lines 62–64 may be grooves and a foot plate 94 with a rocker bar 95 lying in the grooves 62–64 may be used for the target foot.

The apparatus of the invention gives the player a frame of reference and a scale of measurement for the swing of the golf club at the ball with his feet properly positioned for the club and with the feet properly located relative to the ball for the club. This enables the player to get the feel of the proper position. The apparatus gives the player the feel of the correct position of his feet relative to the bsll line and hence relative to the target. The flag spots provide a frame of reference and a scale of measurement for the proper inside-out swing of the club. The tilting foot plates enable the player to gauge the inclination of his knees toward center and to keep his off-target knee bent inwardly during the back, down and foreswing and to hold the target knee bent in during the backswing and to shift his body to his target foot on the down and foreswing and to bend his target knee outwardly to achieve the shift of his body toward the target prior to club impact with the ball. The apparatus shows the player graphically that he should stand closer to the ball with the short shaft clubs and farther from the ball with the long shaft clubs and the difference in the distances for each club. It also graphically demonstrates to the player that he should stand with his knees bent and his buttocks over or slightly back of his heels in a somewhat tail-heavy stance. The apparatus automatically graphically demonstrates the foregoing to a player because he must conform to the proper positions and stance to be able to execute the swing and hit the ball — otherwise he cannot execute the swing and hit a ball toward the target properly. The flags how him the proper inside-out swing and that he must keep his off-target elbow in and his target arm straight or he can't swing the club in the graphically demonstrated inside-out swing.

While the foregoing is stated relative to what the apparatus does for a player with the player's own observation, the apparatus provides the teaching professional with tools, frames of reference, and scales of measurement to graphically demonstrate to the player in positions and actions which words along have heretofore been inadequate to convey to the average player of average athletic ability. The apparatus enables a player to catch on to the fundamentals by himself or with a professional instructor accurately without the usual misunderstandings and inadequacy of telling the player and pushing him through various positions and actions which only add to the confusion.

While a few exemplary embodiments have been shown and described, it will be understood that the scope of the invention is not limited to their structure and that the appended claims define the scope of the invention.

I claim:

1. Apparatus for training a player to position his feet at the proper distance apart, at the proper angles, and at the proper locations relative to a ball for the club being used, comprising, a board a ball line on said board, a target foot position on said board lying at an angle between 10° and 30° to a line leading to (a) said ball line from a point off the inside of the heel of said target foot position, an off-target foot position on said board spaced from said target foot position lying at an angle of 0° to 12° to a line parallel to said ball line;

a scale member on said board at said off-target foot position designating spaced locations of said off-target foot position for a particular club as to sidewise distance from said target foot position, the angle of said off-target foot position to a line parallel to said ball line, and the location of said off-target foot position ahead of, even with, and behind said target foot position;

said foot positions being delineated by foot plates;

longitudinal rocker means on said foot plates;

said foot plates being rockable from side-to-side on said rocker means;

positioning means on said board for angularly locating said rockable foot plates relative to said board and said ball line; and clicker signal means on said foot plates to advise the user of proper and improper rocking of said foot plates.

2. In apparatus as set forth in claim 1, means adjustably mounting said scale member on said board for moving the designated locations of said off-target foot position closer to and farther from said target foot position to provide for the various differences of tall, medium and short players; and means angularly adjustably mounting said target foot position relative to said ball line to provide various angles for said target foot position closer to and farther from parallelism to said ball line to vary the angulation of said target foot position to said ball line.

3. In apparatus as set forth in claim 1, ball position spots on said board on said ball line and a scale on said board designating positions of a ball for particular clubs relative to said foot positions;

a mat on said board having a ball line and ball position spots overlying said ball line and ball position spots on said board;

a club scale at said ball spots on said mat corresponding to said spots and sclae on said board; and means adjustably mounting said mat on said board for moving the designated positions of a ball closer to and farther from said foot positions to provide for the various differences in shaft lengths and heights of tall, medium and short players.

4. In apparatus as set forth in claim 3, said mat having a first auxiliary scale lying parallel to said ball scale and spaced from said ball scale in the target direction and a second auxiliary scale lying parallel to said ball scale and spaced from said ball scale in the off-target direction;

both said auxiliary scales having particular club designations in the same sequence as said ball scale;

said club designations of said target side auxiliary scale lying farther from said foot positions and said club designations of said off-target auxiliary scale lying closer to said foot positions:

said ball scale and said auxiliary scales for each club designation thereby defining a line at an inside-out angle as the path of a club head in the swing of a club at the ball.

5. In apparatus as set forth in claim 4, an upstanding member at said target side auxiliary scale and an upstanding member on said off-target side auxiliary scale;

said upstanding members being movable on said auxiliary scales to locate them at selected ball and club designations;

said upstanding members and a ball on said ball scale visually delineating to a player the path of the club head when traveling at an inside-out angle prior to, at, and after contact with a ball.

6. In apparatus as set forth in claim 5, a transverse projection on each said upstanding member;

said transverse projections lying in the path of a club head when swung in an inside-out swing at a ball at said ball scale so as to be contacted by the club head in a proper swing on an inside-out angle.

* * * * *